US007896204B2

(12) United States Patent
Gouldson

(10) Patent No.: US 7,896,204 B2
(45) Date of Patent: Mar. 1, 2011

(54) MULTIPLE CLIP WRAPAROUND HANGER

(75) Inventor: Stanley F. Gouldson, Northport, NY (US)

(73) Assignee: Spotless Plastics Pty. Ltd., Moorabbin, Victoria (AU)

( * ) Notice: Subject to any disclaimer, the term of this patent is extended or adjusted under 35 U.S.C. 154(b) by 308 days.

(21) Appl. No.: 12/182,501

(22) Filed: Jul. 30, 2008

(65) Prior Publication Data

US 2010/0025440 A1 Feb. 4, 2010

(51) Int. Cl.
*A41D 27/22* (2006.01)

(52) U.S. Cl. ..... 223/96; 223/91

(58) Field of Classification Search ..... 223/85, 223/90, 91, 93, 96, 88; D6/326
See application file for complete search history.

(56) References Cited

U.S. PATENT DOCUMENTS 4,629,102 A 12/1986 Tendrup et al.
4,703,878 A * 11/1987 Louw ..... 223/95
D396,353 S * 7/1998 Gouldson ..... D6/315
5,967,388 A * 10/1999 Kolton et al. ..... 223/96
6,250,523 B1 * 6/2001 Louw ..... 223/96
D459,593 S * 7/2002 Gouldson ..... D6/326
D541,538 S * 5/2007 Gouldson ..... D6/326
2005/0284898 A1 * 12/2005 Fleming ..... 223/85

* cited by examiner

*Primary Examiner*—Gary L Welch
*Assistant Examiner*—Nathan E Durham
(74) *Attorney, Agent, or Firm*—Scully, Scott, Murphy & Presser, P.C.

(57) ABSTRACT

The present invention is a multiple clip wraparound garment hanger with a body having a first arm and a second arm extending laterally outward in opposing directions to a first end and a second end, and a hook extending upward from the body for suspending the garment hanger from a support. A first pair of garment clips is secured to the first and second arms at the first and second ends, respectively. A second pair of garment clips is secured to the body inward of the first and second ends, and a third pair of garment clips secured to the body inward of the second pair of clips. The second and third pairs of garment clips have a first support member and a second support member, each support member having a different thickness. The first support member is substantially flexible and permits deflection of the first support member in a direction into and out of a plane of the body.

19 Claims, 3 Drawing Sheets

MULTIPLE CLIP WRAPAROUND HANGER

BACKGROUND OF THE INVENTION

1. Field of Invention

The present invention relates to the field of garment hangers, and more specifically to a garment hanger having multiple clips for attractively securing and displaying a garment.

2. Description of Related Art

Wraparound garment hangers are so named because a garment wider than the garment hanger, typically but not exclusively women's undergarments or swimsuit bottoms, is wrapped around the garment hanger and held by clips at the ends of the garment hanger. Therefore, the center portion of the garment is displayed, while reducing the width of the display and advantageously increasing display density. However, the outer portion of the garment and/or the garment straps may hang down in an unsightly manner.

Accordingly, additional inward clips were added to certain prior art wraparound garment hangers to hold portions of the garment behind the center portion on display. Although traditional clips secure the center portion of a wide garment, they fail to attractively secure and display the outer portions of the garment as well. Furthermore, the inward clips of the prior art are substantially rigid and make it difficult to repetitiously secure a large number of garments.

Therefore, a wraparound garment hanger having clips with improved flexibility that can hold the outer portions of a garment and/or the garment straps neatly without protruding from behind the central display portion of the garment and which permit repetitious handling is desirable in the art.

BRIEF SUMMARY OF THE INVENTION

In accordance with one aspect of the present invention, a multiple clip wraparound garment hanger is provided. The hanger includes a body having a first arm and a second arm extending laterally outward in opposing directions to a first end and a second end, respectively, and a hook extending upward from the body for suspending the garment hanger from a support at a generally central location. A first pair of garment clips is secured to the first and second arms at the first and second ends, respectively. A second pair of garment clips is secured to the body inward of the first and second ends, and a third pair of garment clips is secured to the body inward of the second pair of clips. The second and third pairs of garment clips include a first support member and a second support member having a different thickness than the thickness of the first support member. The first support member is substantially flexible for permitting deflection of the first support member in a direction into and out of a plane of the body.

With this arrangement, as a garment is inserted into the second and third pairs of garment clips, it is easier for a worker to insert the garment and/or the garment strap between the first and second support members. Furthermore, the compound movement of each garment clip of the first pair of garment clips results in the garment receiving channel of the clip first opening to allow the garment to enter, and then closing to securely retain the garment therein. The center portion of the garment is displayed, while reducing the width of the display and advantageously increasing display density. However, the outer portions of the garment and/or the garment straps are advantageously secured behind the garment within a garment clip.

Optionally, each garment clip of the first pair of garment clips includes a vertical support member vertically extending from the first and second arms at the first and second ends, respectively. Each garment clip of the first pair of garment clips further includes a cantilever mount connecting the vertical support member to an inner support member, the inner support member extending down vertically from the body. Each garment clip of the first pair of garment clips further includes a first mouth defined by the vertical support member and the inner support member, wherein the first mouth guides a garment into the first pair of garment clips.

Furthermore, each garment clip of the first pair of garment clips includes a first toothed section disposed along the inner edge of the vertical support member and a second toothed section disposed along an outer edge of the inner support member. In this configuration, the first toothed section and the second toothed section oppose each other to form a garment receiving channel that grasps and retains the garment.

Furthermore, the second and third pairs of garment clips of the present invention are designed with a much greater flexibility, without a stiffening rib extending along the length of the first support member. The more flexible first support member is much easier to open and use, and provides greater flexibility for the insertion of garments. This greatly alleviates problems with carpel tunnel syndrome by persons who are employed to insert a great number of garments into a great number of such garment clips. To achieve this, the thickness and length of the first support member are different than the thickness and the length of the second support member. The first support member extends vertically down from the body and curves away from the second support member to define a second mouth. As the garment and/or garment strap enters the second mouth, the first support member begins to deflect in a direction into and out of a plane of the body. The second support member includes a substantially U-shaped member having a first free end and a second end integrally molded with the body. Because the second support member has a greater thickness than the first support member, the second support member is more resistant to movement into and out of the plane of the body. However, as the garment and/or garment strap moves further towards the body, the first free end of the U-shaped member deflects in a direction transverse to the plane of the body.

Optionally, each of the first, second and third pairs of garment clips are integrally molded with the body and located approximately equidistant from a centerline of the body, respectively. Furthermore, the garment hanger is made from at least one injection molded plastic selected from the group consisting of styrene, styrene polypropylene, polypropylene, polyvinyl chloride, nylon, K resin and acrylics.

BRIEF DESCRIPTION OF THE DRAWINGS

The foregoing objects and advantages of the present invention for a garment hanger may be more readily understood by one skilled in the art with reference being had to the following detailed description of a preferred embodiment thereof, taken in conjunction with the accompanying drawings, wherein like elements are designated by identical reference numerals throughout the several views, and in which.

DETAILED DESCRIPTION OF THE INVENTION

Figure 1:
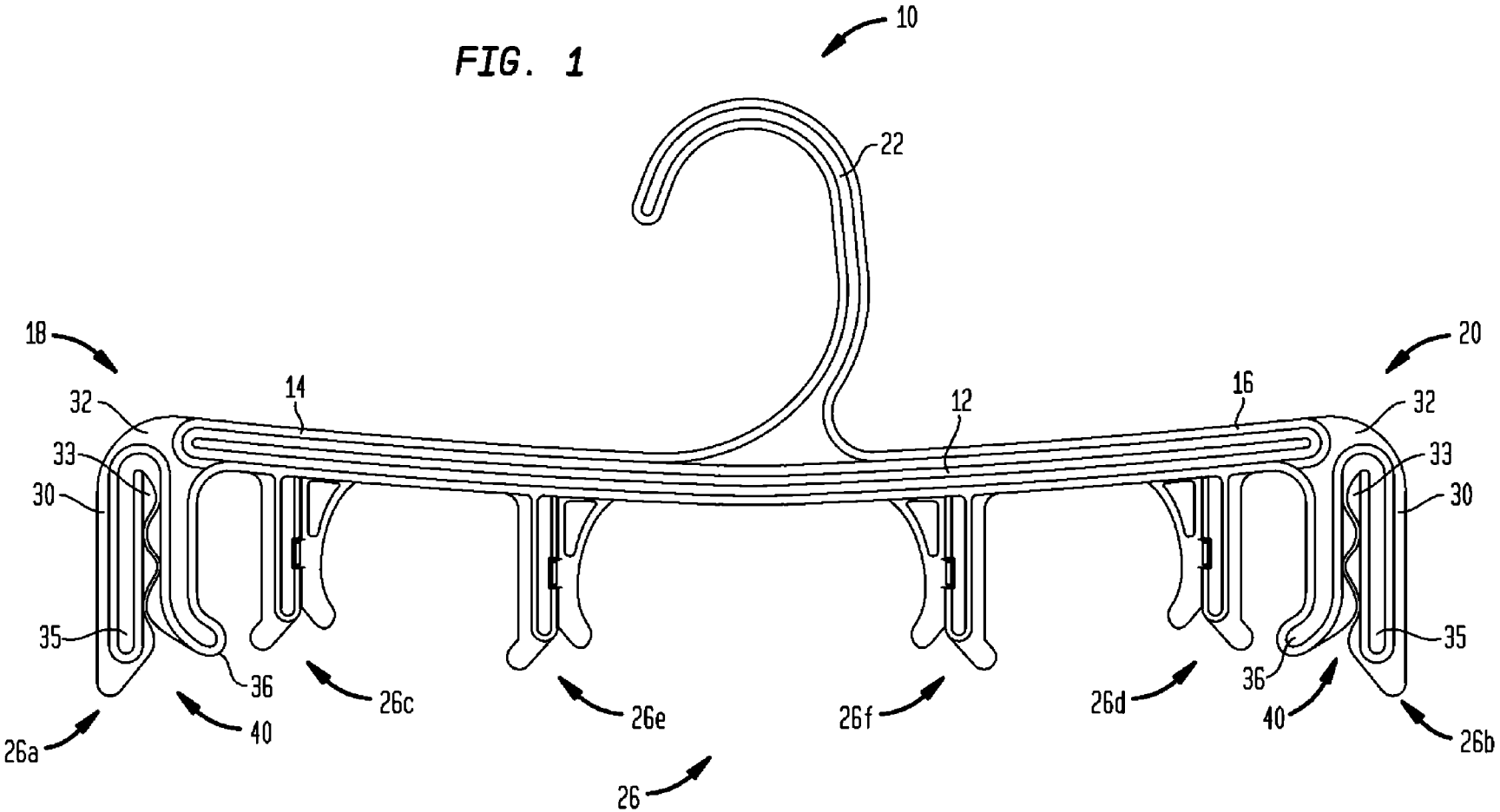
FIG. 1 is a front elevation view of a garment hanger according to an exemplary embodiment of the present invention.
Figure 2:
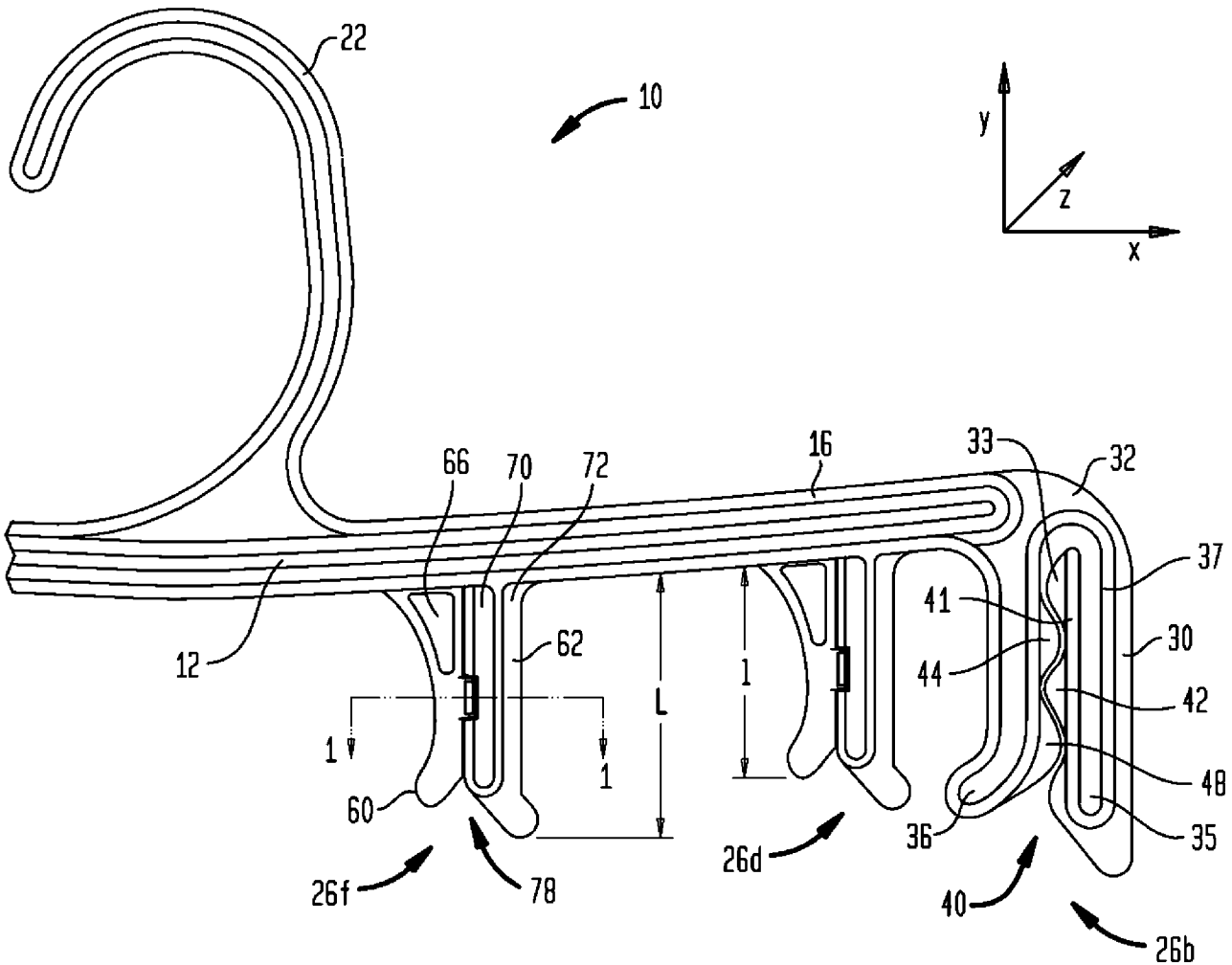
FIG. 2 is a front elevation view of a first, second and third pair of garment clips of the hanger according to an exemplary embodiment of the present invention.

Referring now to FIGS. 1 and 2, illustrated is a multiple clip garment hanger (hereinafter "garment hanger") 10 according to a first embodiment of the present invention. Garment hanger 10 has a body 12, with a first arm 14 and a second arm 16 extending laterally outward in opposing directions to respective first and second ends 18, 20. A hook 22 extends upward from the body 12 for suspending the garment hanger 10 from a support (not shown). The particular illustrated shapes of the central hook member 12 and the first and second arms 14, 16 are exemplary only, and may vary in number and shape.

As shown in FIGS. 1-2, a plurality of garment clips 26 are secured to the garment hanger 10, and are optionally integrally molded with the body 12 and/or arms 14, 16. A first pair of garment clips 26*a*, 26*b* are secured to the first and second arms 14, 16 at the first and second ends 18, 20, respectively. A second pair of garment clips 26*c*, 26*d* are secured to the garment hanger body 12 inward of the first and second ends 18, 20. Finally, a third pair of clips 26*e*, 26*f*, is secured to the body 12 still further inward of the second pair of clips 26*c*, 26*d*. The second and third pairs of clips 26*d*-26*f* are located approximately equidistant from a centerline A-A of the body 12. Optionally, the second pair of clips 26*c*, 26*d* are each equidistant from the clips 26*a*, 26*b* of the first pair, and clips 26*e*, 26*f* of the third pair.

The plurality of clips 26 are preferably double-action clips, for example as described in U.S. Pat. No. 4,629,102 to Tendrup, et al., the complete disclosure of which is hereby incorporated by reference. A double-action clip has a cooperating finger and an opposite member to engage an interposed garment therebetween. The finger is movable into a clearance provided behind it to allow for the bulk of the garment. This adjustment in position of the finger relieves stresses in the plastic at the juncture of the finger connection to the garment hanger, thus reducing the tendency of rupture at said juncture.

As shown in FIGS. 1 and 2, each garment clip of the first pair of garment clips 26*a*, 26*b* includes a vertical support member 30 vertically extending from the first and second arms 14, 16 at the first and second ends 18, 20, respectively. Each garment clip 26*a*, 26*b* also includes a cantilever mount 32 connecting the vertical support member 30 to an inner support member 36 extending down vertically from the body 12. This configuration forms a first mouth 40 defined by the vertical support member 30 and the inner support member 36, wherein the first mouth 40 guides a garment into the first pair of garment clips 26*a*, 26*b*. In this embodiment, the vertical support member 30 is substantially U-shaped and has a free end 33 supported by a web 35. The web 35 stiffens the vertical support member 30 and decreases movement of the free end 33 in a direction transverse to the plane of the body 10.

The construction and design are such that as a garment or strap is initially inserted into the mouth 40, the combination of the vertical support member 30 and the inner support member 36 rotates about the cantilever mount 32. During initial insertion of the garment, the vertical support member 30 bends outwardly. As the garment slides towards the free end 33 of the vertical support member 30, it causes an outward flexure of the free end 33 of the vertical support member 30. This results in an inward deflection of the vertical support member 30 near the mouth 40 and a closing of the bottom of the vertical support member 30. Accordingly, as a garment is inserted into the first pair of garment clips 26*a*, 26*b*, the compound movement of the vertical support member 30 and the inner support member 36 results in the mouth 40 of the clip first opening to allow the garment to enter, and then closing to securely retain the garment.

As best shown in FIG. 2, each garment clip of the first pair of garment clips 26*a* (not shown), 26*b* includes a first toothed section 42 disposed along an inner edge 37 of the vertical support member 30 and a second toothed section 44 disposed along an outer edge 41 of the inner support member 36. The first toothed section 42 and the second toothed section 44 oppose each other to form a garment receiving channel 48 that grasps and retains the garment.

Figure 3:
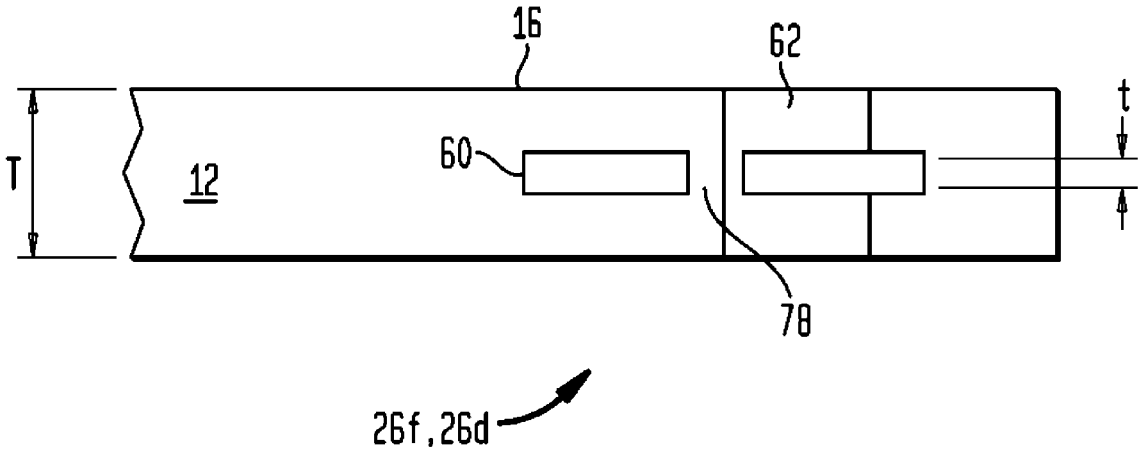
FIG. 3 is an enlarged sectional view, taken along sectional arrows 1-1 in FIG. 2, and illustrates further details of construction of the second and third pairs of garment clips.

Referring now to FIGS. 2 and 3, the second and third pair of garment clips 26*d*-26*f* will be described in greater detail. As shown best in the enlarged sectional view of FIG. 3, each of the second and third pairs of garment clips 26*d*, 26*f* includes a first support member 60 and a second support member 62 having a different thickness (T) than the thickness (t) of the first support member 60. The second support member 62 is optionally constructed to have the same thickness (T) as the body 12. The first support member 60 is substantially flexible and permits deflection of the first support member 60 in a direction into and out of a plane of the body 12. As shown, because the thickness (t) of the first support member 60 is less than the thickness (T) of the second support member 62, the first support member 60 deflects in the z-direction into and out of the x-y plane of the body 12. However, the first support member 60 generally resists movement in a direction transverse to the x-y plane of the body 12.

Furthermore, as shown in FIG. 2, to increase the flexibility of the first support member 60, an opening 66 is provided adjacent to the body 12 within the first support member 60. The opening 66 reduces the amount of material in the first support member 60 and thereby decreases the rigidity of the first support member 60 near the body 12. The first support member 60 extends vertically down from the body 12 and curves away from the second support member 62 to define a second mouth 78.

The second mouth 78 guides a garment and/or garment strap into the third pair of garment clips 26*e*, 26*f* As also shown, the length (1) of the first support member 60 is less than the length (L) of the second support member 62. However, it can be appreciated that the lengths of the first and second support members 60, 62 relative to each other can vary without departing from the spirit or scope of the invention.

As best shown in FIG. 2, the second member 62 is substantially U-shaped and has a first free end 70 and a second end 72 integrally molded with the body 12. The second support member 62 is relatively inflexible as compared to the first support member 60 and generally resists deflection in the z-direction into and out of the x-y plane of the body 12. However, unlike the vertical support member 30 of the first pair of garment clips 26*a*, 26*b*, the second member 62 has no supportive web. Therefore, the first free end 70 is generally flexible and permits deflection in a direction transverse to and from the x-y plane of the body 12. This transverse deflection is beneficial because it reduces the likelihood that the second member 62 will fail when a garment and/or a garment strap is inserted therein.

In a preferred embodiment, a garment is inserted into and wrapped around the first pair of clips 26*a*, 26*b* to display the central portion of the garment. The outer portions of the garment extending beyond the first pair of clips 26*a*, 26*b*, would be passed through the innermost pair of clips 26*e*, 26*f*. The remaining portion of the garment extending beyond the innermost pair of clips 26*e*, 26*f* would be placed through and secured by the intermediate pair of clips 26*c*, 26*d*, so as to conceal the remaining portion beneath and behind the center portion of the garment.

The more flexible first support member 60 is much easier to open and use, and provides greater flexibility for the insertion of garments. This greatly alleviates problems with carpel tunnel syndrome associated with rigid garment clips having little flexibility in a direction into and out of the plane of the body.

The inventive plastic garment hanger can be formed of styrene which provides a clear, virtually transparent polystyrene garment hanger for maximum display of the garment to be suspended therefrom. Alternatively, the garment hanger 10 can be molded from styrene polypropylene, polypropylene, polyvinychloride, ABS or other suitable thermoplastics and mixtures thereof. For additional reinforcement, K resin can be added to the plastic material. The preferred material, polystyrene, has a Flexural Modulus, MPa, of 3,170, taken from CONCISE ENCYCLOPEDIA OF POLYMER SCIENCE AND ENGINEERING, p. 1117.

Thus, while there have shown and described and pointed out fundamental novel features of the invention as applied to various specific embodiments thereof, it will be understood that various omissions and substitutions and changes in the form and details of the hanger illustrated may be made by those skilled in the art without departing from the spirit of the invention. Moreover, it should be recognized that structures shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed:

1. A multiple clip wraparound garment hanger, comprising:

a body having a first arm and a second arm extending laterally outward in opposing directions to a first end and a second end;

a hook extending upward from the body for suspending the garment hanger from a support;

a first pair of garment clips secured to the first and second arms at the first and second ends, respectively;

a second pair of garment clips secured to the body inward of the first and second ends; and a third pair of garment clips secured to the body inward of the second pair of clips, wherein each of the second and third pairs of garment clips comprises a first support member and a second support member, respectively, the first support member having a first unitary thickness along a direction transverse to the hanger body, the second support member having a substantially U-shaped body, the substantially U-shaped body having a second unitary thickness along the direction transverse to the hanger body, and wherein the first unitary thickness is substantially smaller than the second unitary thickness, such that the first member can be deflected with respect to the second member in a direction into and out of the plane of the hanger body.

2. The garment hanger of claim 1, wherein the first, second and third pairs of garment clips are integrally molded with the body.

3. The garment hanger of claim 1, wherein each garment clip of the first pair of garment clips comprises:

a vertical support member vertically extending from the first and second arms at the first and second ends, respectively;

a cantilever mount connecting the vertical support member to an inner support member, the inner support member extending down vertically from the body; and a first mouth defined by the vertical support member and the inner support member for guiding a garment into the first pair of garment clips.

4. The garment hanger of claim 3, further comprising a first toothed section disposed along the inner edge of the vertical support member and a second toothed section disposed along an outer edge of the inner support member, wherein the first toothed section and the second toothed section oppose each other to form a garment receiving channel that grasps and retains the garment.

5. The garment hanger of claim 1, wherein the second support member comprises a first free end and a second end integrally molded with the body.

6. The garment hanger of claim 1, wherein the first support member extends vertically down from the body and curves away from the second support member to define a second mouth.

7. The garment hanger according to claim 1, wherein the second pair of clips are located approximately equidistant from a centerline of the body.

8. The garment hanger according to claim 1, wherein the third pair of clips are located approximately equidistant from a centerline of the body.

9. The garment hanger according to claim 1, wherein the garment hanger comprises at least one injection molded plastic selected from the group consisting of styrene, styrene polypropylene, polypropylene, polyvinyl chloride, nylon, K resin and acrylics.

10. A multiple clip wraparound garment hanger, comprising:

a body having a first arm and a second arm extending laterally outward in opposing directions to a first end and a second end;

a hook extending upward from the body for suspending the garment hanger from a support;

a first pair of garment clips secured to the first and second arms at the first and second ends, respectively;

a second pair of garment clips secured to the body inward of the first and second ends; and a third pair of garment clips secured to the body inward of the second pair of clips, wherein each of the second and third pairs of garment clips comprises a first support member and a second support member, respectively, the first support member having a first unitary thickness along a direction transverse to the hanger body and a first length extending downward from the hanger body, the second support member having a substantially U-shaped body, the substantially U-shaped body having a second unitary thickness along the direction transverse to the hanger body and a second length extending downward from the hanger body, and wherein the first length is different from the second length, and the first unitary thickness is substantially smaller than the second unitary thickness, such that the first member can be deflected with respect to the second member in a direction into and out of the plane of the hanger body.

11. The garment hanger of claim 10, wherein the first, second and third pairs of garment clips are integrally molded with the body.

12. The garment hanger of claim 10, wherein the first length of the first support member is less than the second length of the second support member.

13. The garment hanger of claim 10, wherein each garment clip of the first pair of garment clips comprises:

a vertical support member vertically extending from the first and second arms at the first and second ends, respectively;

a cantilever mount connecting the vertical support member to an inner support member, the inner support member extending down vertically from the body; and a first mouth defined by the vertical support member and the inner support member, wherein the first mouth guides a garment into the first pair of garment clips.

14. The garment hanger of claim 13, further comprising a first toothed section disposed along the inner edge of the vertical support member and a second toothed section disposed along an outer edge of the inner support member, wherein the first toothed section and the second toothed section oppose each other to form a garment receiving channel that grasps and retains the garment.

15. The garment hanger of claim 10, wherein the second support member comprises a first free end and a second end integrally molded with the body.

16. The garment hanger of claim 10, wherein the first support member extends vertically down from the body and curves away from the second support member to define a second mouth.

17. The garment hanger according to claim 10, wherein the second and third pairs of clips are located approximately equidistant from a centerline of the body.

18. The garment hanger according to claim 10, wherein the garment hanger comprises at least one injection molded plastic selected from the group consisting of: styrene, styrene polypropylene, polypropylene, polyvinyl chloride, nylon, K resin and acrylics.

19. A multiple clip wraparound garment hanger comprising:

a body having a first arm and a second arm extending laterally outward in opposing directions to a first end and a second end;

a hook extending upward from the body for suspending the garment hanger from a support;

a first pair of garment clips secured to the first and second arms at the first and second ends, respectively;

a second pair of garment clips secured to the body inward of the first and second ends; and a third pair of garment clips secured to the body inward of the second pair of clips, wherein each of the second and third pairs of garment clips comprises a first support member and a substantially rigid second support member, respectively, the first support member having a first unitary thickness along a direction transverse to the hanger body, the second support member having a substantially U-shaped body, the substantially U-shaped body having a second unitary thickness along the direction transverse to the hanger body, and wherein the first unitary thickness is substantially smaller than the second unitary thickness, such that the first member can be deflected with respect to the substantially rigid second member in a direction into and out of the plane of the hanger body.

* * * * *